US012508476B2

(12) United States Patent
Wiggins et al.

(10) Patent No.: US 12,508,476 B2
(45) Date of Patent: Dec. 30, 2025

(54) NON-SPHERICAL AND MASS SHIFTED ATHLETIC TRAINING BALL

(71) Applicant: SPINDR SPORTS LLC, Austin, TX (US)

(72) Inventors: Jamie Southern Wiggins, Leander, TX (US); Mark G. Wiggins, Leander, TX (US)

(73) Assignee: SpinDr Sports LLC, Austin, TX (US)

( * ) Notice: Subject to any disclaimer, the term of this patent is extended or adjusted under 35 U.S.C. 154(b) by 0 days.

(21) Appl. No.: 17/728,976

(22) Filed: Apr. 25, 2022

(65) Prior Publication Data

US 2022/0401798 A1 Dec. 22, 2022

Related U.S. Application Data

(60) Provisional application No. 63/179,049, filed on Apr. 23, 2021.

(51) Int. Cl.

| | |
|---|---|
| ***A63B 43/00*** | (2006.01) |
| ***A63B 39/00*** | (2006.01) |
| ***A63B 69/00*** | (2006.01) |
| *A63B 102/18* | (2015.01) |

(52) U.S. Cl.

CPC ..... *A63B 43/002* (2013.01); *A63B 39/00* (2013.01); *A63B 43/008* (2013.01); *A63B 69/0002* (2013.01); *A63B 2069/0006* (2013.01); *A63B 2102/18* (2015.10)

(58) Field of Classification Search

CPC ..... A63B 43/002; A63B 39/00; A63B 43/008; A63B 69/0002; A63B 2069/0006; A63B 2102/18

See application file for complete search history.

(56) References Cited

U.S. PATENT DOCUMENTS

| | | | | |
|---|---|---|---|---|
| 1,656,936 A * | 1/1928 | Beal | A63B 67/14 | 473/569 |
| 3,099,450 A * | 7/1963 | Randall | A63H 33/18 | 473/588 |
| 3,416,800 A * | 12/1968 | Randall | A63F 7/40 | 473/588 |

(Continued)

FOREIGN PATENT DOCUMENTS

| | | | |
|---|---|---|---|
| DE | 202012000254 U1 * | 7/2012 | A63B 21/072 |
| WO | WO-2006063391 A1 * | 6/2006 | A63B 37/0003 |
| WO | WO-2013191751 A1 * | 12/2013 | A63B 43/002 |

*Primary Examiner* — Steven B Wong

(74) *Attorney, Agent, or Firm* — John Wood; Wood Patent Law

(57) ABSTRACT

A non-spherical training ball for training a pitcher to throw a ball with proper technique is provided. The training ball has a hollow body having a spherical surface forming a spherical cap having a height greater than the radius of the sphere from which the spherical cap is formed and a substantially planar surface forming the spherical cap plane. Sidewalls form the hollow cavity of the hollow body, the sidewalls have a spherical surface sidewall portion forming the spherical surface of the hollow body and a planar surface sidewall portion forming the substantially planar surface of (Continued)

the hollow body. The sidewall thickness of the planar surface sidewall portion has a thickness greater than the sidewall thickness of the spherical surface sidewall portion.

7 Claims, 6 Drawing Sheets

(56) References Cited

U.S. PATENT DOCUMENTS 3,930,650 A * 1/1976 Watson ..... A63H 33/18 473/588
4,128,238 A * 12/1978 Newcomb ..... A63B 43/04 273/DIG. 20
5,035,425 A * 7/1991 Edwards ..... A63B 39/00 119/711
5,472,187 A * 12/1995 Kempf ..... A63B 65/10 473/597
6,264,574 B1 * 7/2001 Nelson ..... A63B 65/00 473/603
6,575,885 B1 * 6/2003 Weck ..... A63B 21/0004 482/148
7,819,762 B2 * 10/2010 Bernal-Silva ..... A63B 69/3655 473/409
D654,539 S * 2/2012 Hobbs ..... D19/95
8,708,843 B1 * 4/2014 Sekac ..... A63B 43/002 473/422
D819,824 S * 6/2018 Moehlenbrock ..... D24/211
10,561,915 B1 * 2/2020 McGuiness ..... A63B 69/0002
2002/0147062 A1 * 10/2002 Moore, Jr. ..... A63B 69/0053 473/569
2007/0093308 A1 * 4/2007 Rice ..... A63B 69/3661 473/157
2009/0243134 A1 * 10/2009 Hu ..... B29D 22/04 264/45.5
2010/0240278 A1 * 9/2010 Neal ..... A63B 67/14 446/489
2014/0094328 A1 * 4/2014 Shearer ..... A63B 69/0002 473/451
2016/0206929 A1 * 7/2016 Yuan ..... B29C 43/14
2020/0015454 A1 * 1/2020 Sporn ..... A01K 15/025
2020/0070026 A1 * 3/2020 Holman ..... A63B 43/002
2020/0246665 A1 * 8/2020 Teperson ..... A63B 37/12

* cited by examiner

NON-SPHERICAL AND MASS SHIFTED ATHLETIC TRAINING BALL

CROSS-REFERENCE TO RELATED APPLICATIONS

This application claims the benefit of U.S. Provisional Patent Application Ser. No. 63/179,049 filed Apr. 23, 2021, which is hereby incorporated by reference in its entirety.

FIELD

This disclosure relates to generally articles, kits, and methods for training athletes, such as pitchers. More specifically, this disclosure is related to a non-spherical and mass shifted training ball suitable for helping a pitcher, such as a softball or baseball pitcher, visualize the spin of the training ball that results from a pitch thrown by the pitcher.

BACKGROUND

Softball and baseball players, especially pitchers, regularly practice their throwing to improve performance. A key element of throwing in softball and baseball, especially for pitchers, is maintaining control of spin. Spin may refer to the axis and rate of rotation of the ball as it flies after being thrown, and in some cases, may dictate ball movement and ultimately determine whether a pitch is effective in a competitive setting. Ordinary balls, including softballs and baseballs, do not enable pitchers to receive immediate visual feedback of the axis and rate of rotation obtained from a pitch, which may make it difficult for pitchers to adjust their technique for optimal results.

Accordingly, there is a need for a training ball that enables immediate visual feedback of the axis and rate of rotation of the ball after being thrown. The present invention addresses this unmet need.

SUMMARY

According to one aspect of the disclosed subject matter, a training ball for training a pitcher to throw a ball with proper technique is provided.

These and other aspects of the disclosed subject matter, as well as additional novel features, will be apparent from the description provided herein. The intent of this summary is not to be a comprehensive description of the claimed subject matter, but rather to provide a short overview of some of the subject matter's functionality. Other systems, methods, features and advantages here provided will become apparent to one with skill in the art upon examination of the following FIGUREs and detailed description. It is intended that all such additional systems, methods, features and advantages that are included within this description, be within the scope of any claims.

BRIEF DESCRIPTION OF THE FIGURES

The features, natures, and advantages of the disclosed subject matter may become more apparent from the detailed description set forth below when taken in conjunction with the drawings in which like reference numerals indicate like features.

DESCRIPTION

Figure 1:
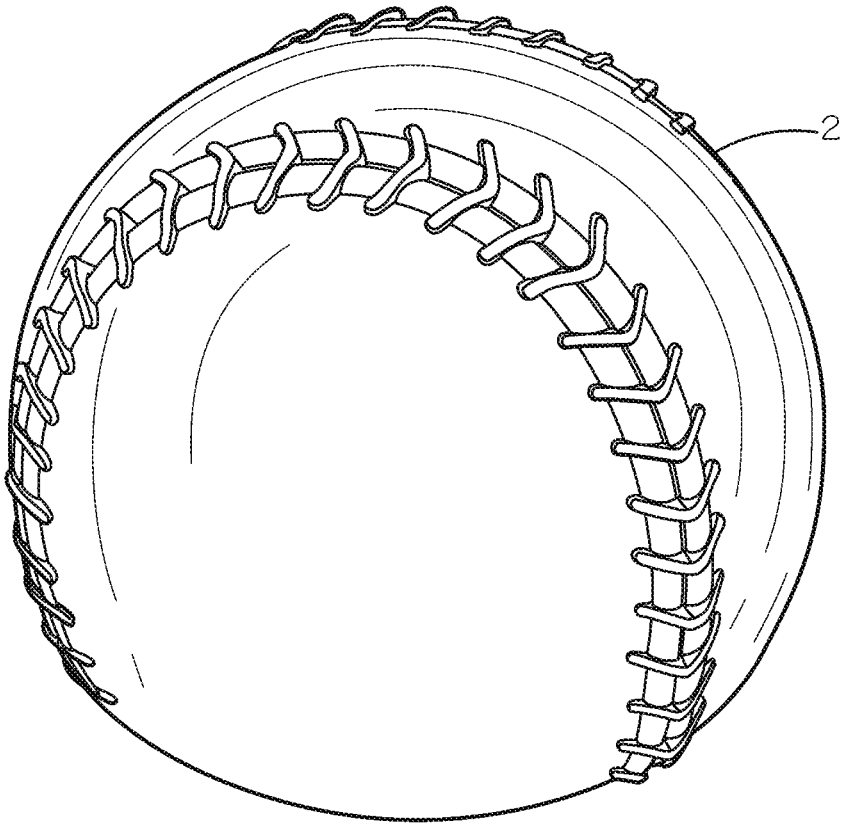
FIGS. 1 through 8 are drawings of an embodiment of the non-spherical training ball for pitchers according to the disclosed subject matter.

The following description is not to be taken in a limiting sense, but is made for the purpose of describing the general principles of the present disclosure. The scope of the present disclosure should be determined with reference to the claims. Exemplary embodiments of the present disclosure may be illustrated in the drawings, like numbers being used to refer to like and corresponding parts of the various drawings. The dimensions of drawings provided are not shown to scale.

The present application provides a training ball that is non-spherical and has a shifted center of mass due to the ball having at least one sidewall having an interior thickness greater than that of other portions. Because the training ball is not geometrically symmetrical about all axes, the mass of the ball is distributed such that it is located in the geometric center of the outer sphere of the training ball. Because of the redistribution of mass and relocation of the geometric center, the training ball feels similar or identical to an ordinary ball when held by the pitcher and, when thrown, spins similar or identical to an ordinary ball.

In one aspect, the invention provides an article comprising a non-spherical ball that is configured to fly without substantial eccentricity when thrown. The non-spherical ball may comprise at least one density differential or density gradient, such that the mass of the ball was distributed so that it would be located in the geometric center of the outer sphere of the training ball. The non-spherical ball is without a complementary portion which, if combined with the non-spherical ball, would form the corresponding spherical ball. In embodiments, the complementary portion may be a smaller spherical cap.

In embodiments, the non-spherical ball may comprise indicia thereon, configured to enhance visualization of spin of the ball when thrown, which may include one or more of a color, a plurality of colors (e.g., contrasted colors), a word, a phrase, a logo, and any combination thereof. To impart the non-spherical shape to the ball, a diameter of the non-spherical ball may be less than (e.g., 75% of) a diameter of the corresponding spherical ball.

In embodiments, the non-spherical ball may comprise at least one raised seam to facilitate gripping of the ball during use. The ball may be comprised of a silicone rubber, silicone, or rubber material to improve durability relative to ordinary balls. The non-spherical ball may be manufactured via an injection molding process for economic, accurate, and precise production. In embodiments, the non-spherical ball may have a total mass that is at least approximately equal to a total mass of a corresponding spherical ball. In embodiments, the non-spherical ball may comprise a tacky exterior surface configured to enhance a pitcher's grip of the ball.

Another object of the present invention is to provide articles, kits, and methods for training a pitcher, and processes for manufacturing articles and kits of the invention, which may be easily scaled to meet the demand for improved athletic training procedures.

Figure 2:
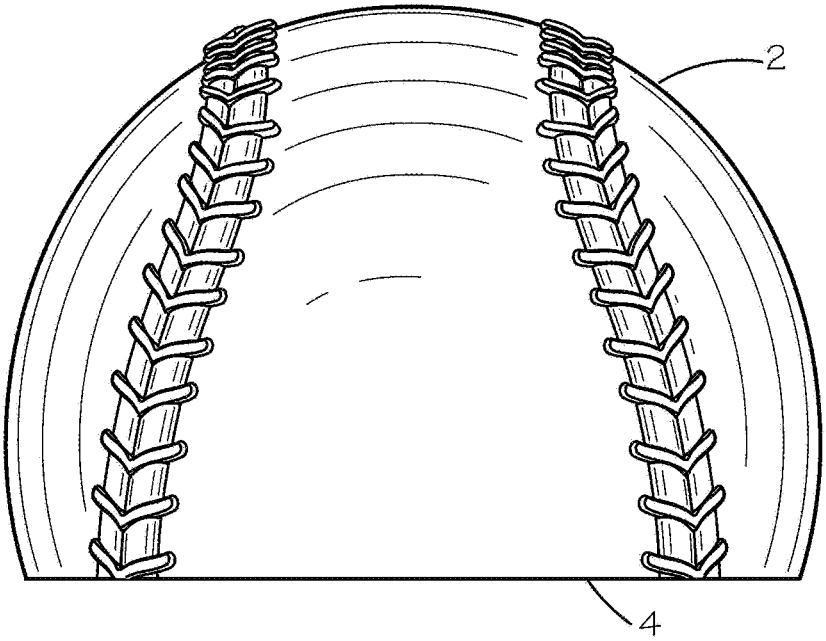
Figure 3:
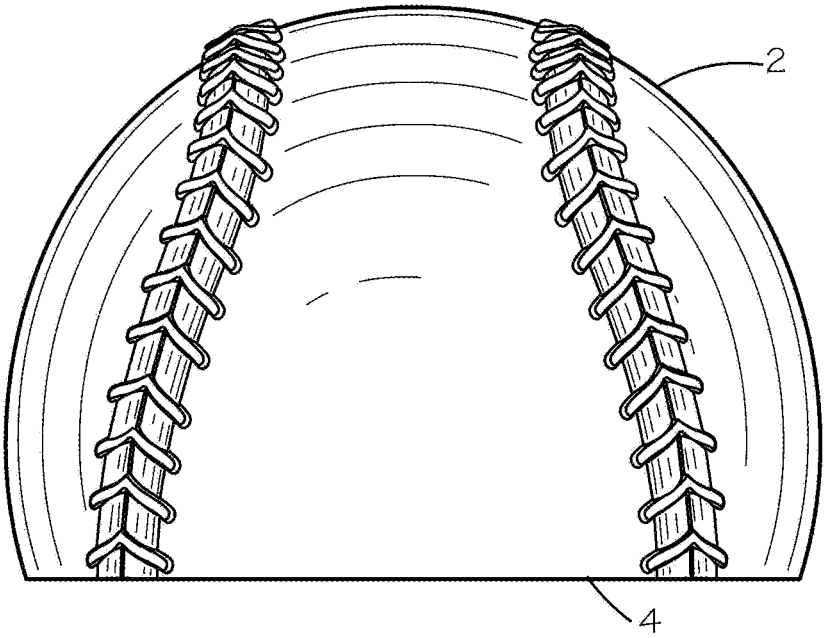
Figure 4:
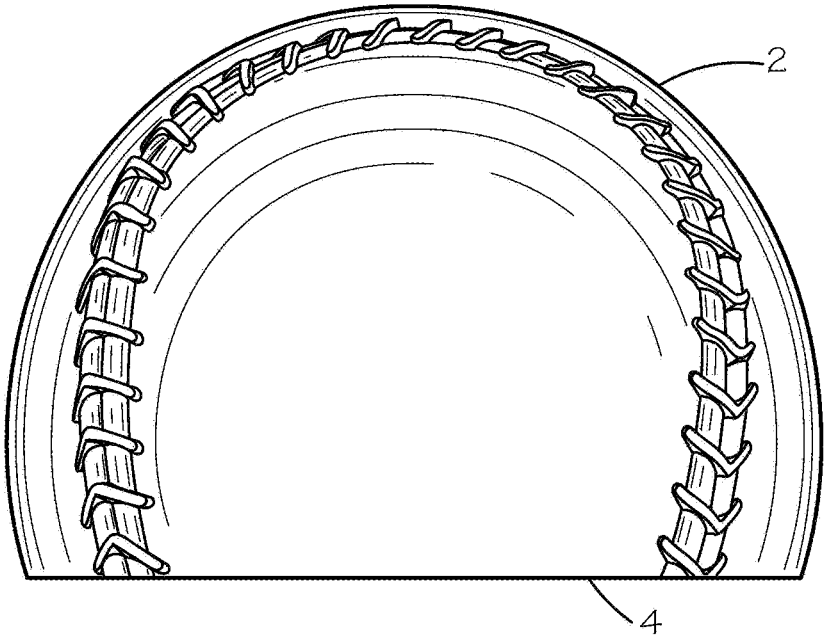
Figure 5:
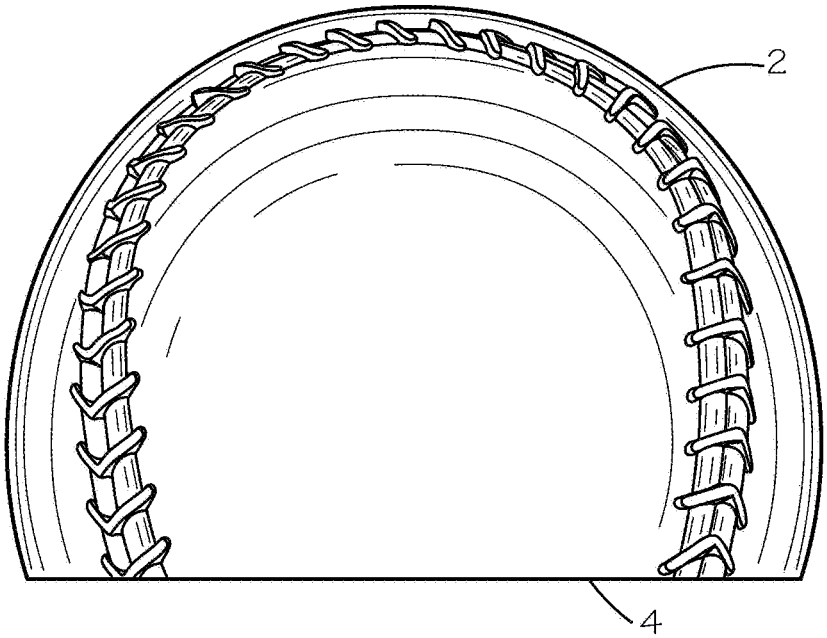
Figure 6:
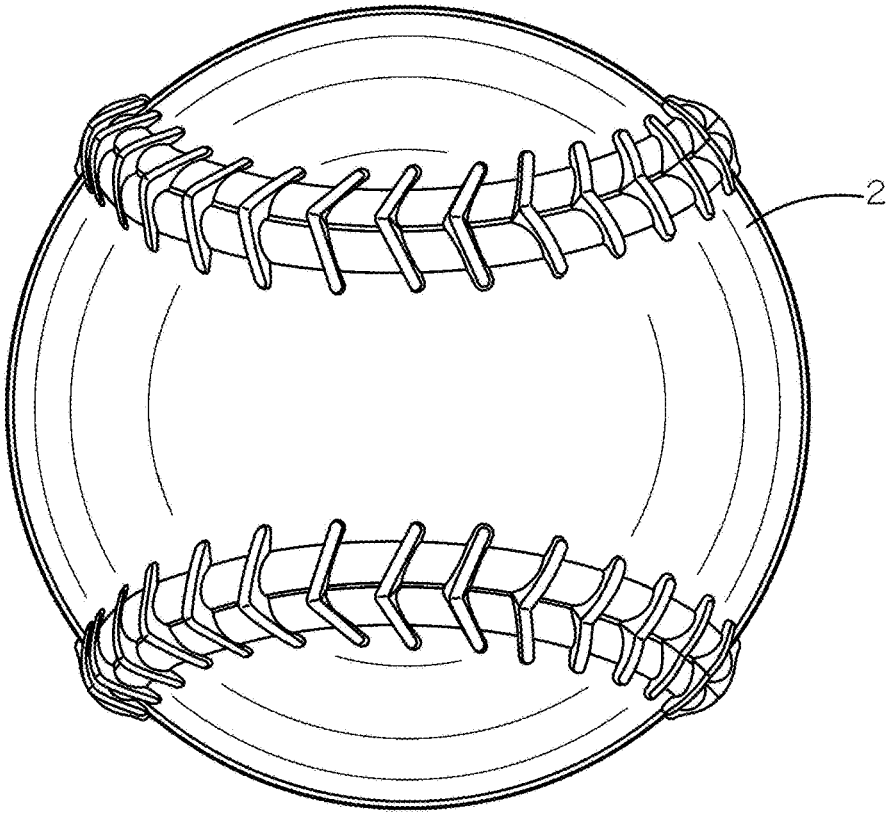
Figure 7:
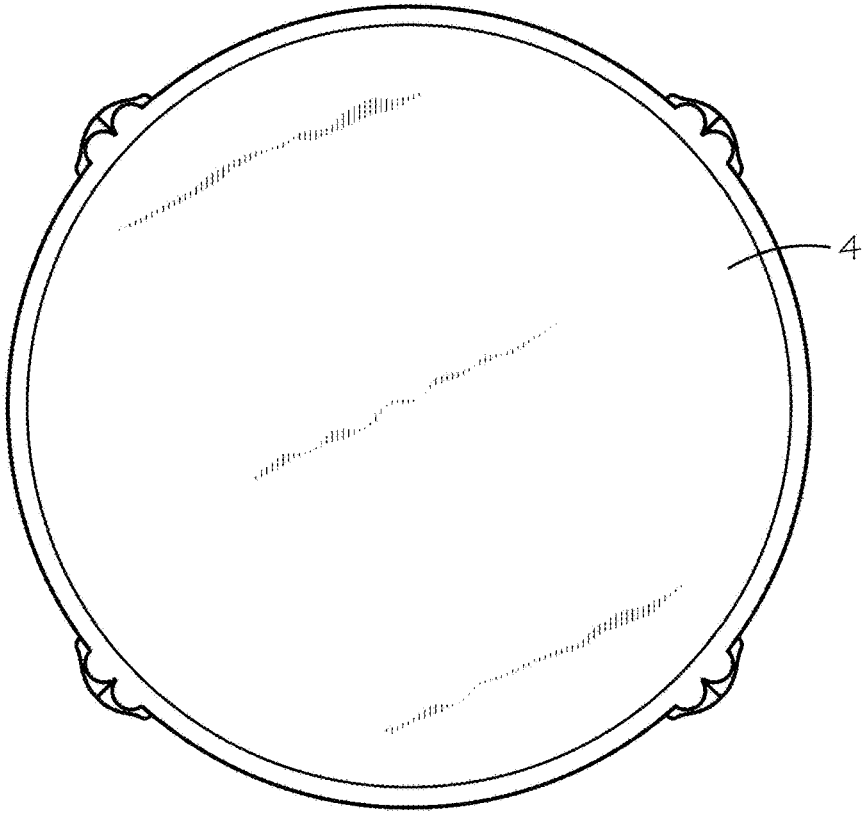
Figure 8:
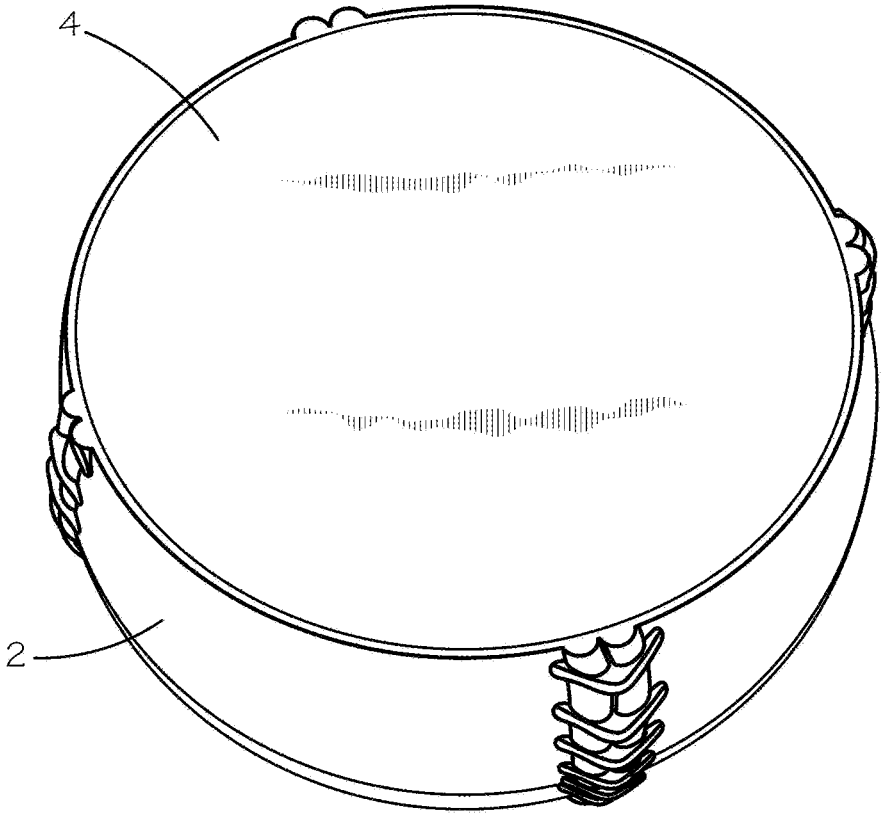

FIGS. 1 through 8 are drawings of an embodiment of the non-spherical training ball for pitchers according to the disclosed subject matter showing spherical surface 2 and substantially planar surface 4. Specifically, FIG. 1 is a top front perspective view. FIG. 2 is a left side view. FIG. 3 is a right side view. FIG. 4 is a front view. FIG. 5 is a rear view. FIG. 6 if a top view. FIG. 7 is a bottom view. And FIG. 8 is a bottom front perspective view. Spherical surface 2 forms a spherical cap having a height greater than the radius of the sphere from which the spherical cap is formed and substantially planar surface 4 forms the spherical cap plane.

Figure 9:
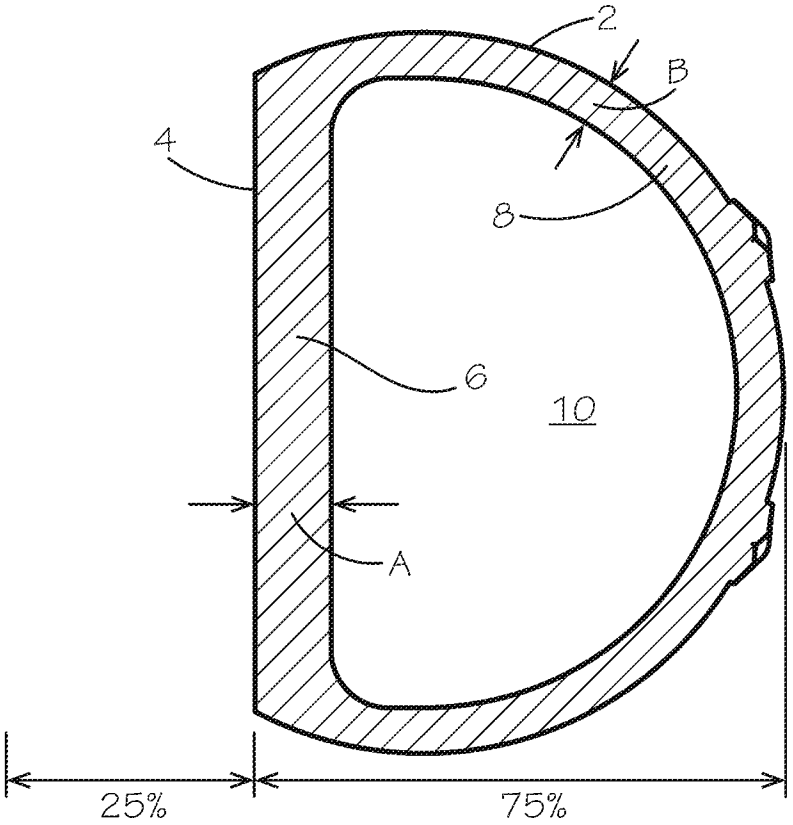
FIG. 9 is a cross-sectional view of the non-spherical training ball of FIGS. 1 through 8.

FIG. 9 is a cross-sectional view of the non-spherical training ball of FIGS. 1 through 8 showing spherical surface sidewall portion 8 forming said spherical surface 2 and planar surface sidewall portion 6 forming said substantially planar surface 4 around hollow cavity 10 of the hollow body the non-spherical training ball. The thickness A of planar surface sidewall portion 6 is greater than the thickness B of spherical surface sidewall portion 8 thus adjusting the center of mass of the non-spherical training ball closer to planar surface sidewall portion 6. In some instances the difference between thickness A and thickness B may be such that the center of mass of the non-spherical training ball is moved to the geographic center of the sphere from which the spherical cap of the non-spherical portion is formed to provide a spin rotation more closely resembling a wholly spherical ball while still retaining the benefits of the planar portion (e.g., to visualize ball spin to improve pitching technique).

Figure 10:
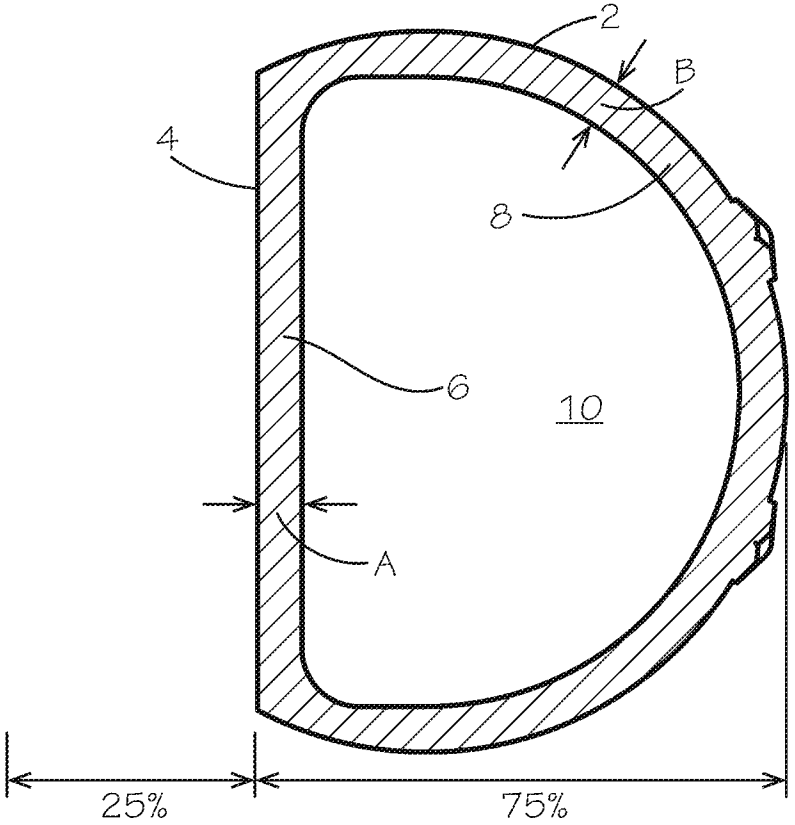
FIG. 10 shows the non-spherical training ball of FIG. 9 having a uniform sidewall thickness for descriptive purposes.

In contrast, for descriptive purposes FIG. 10 shows the non-spherical training ball of FIG. 9 having a uniform sidewall thickness such that sidewall thickness A equals sidewall thickness B.

In some instances as shown in FIG. 9, the diameter of said non-spherical training ball is approximately 75% of the diameter of the sphere from which the spherical cap is formed. In other words, the diameter of the non-spherical ball is less than a diameter of a corresponding spherical ball and may be about or approximately 75% of the diameter of the corresponding spherical ball. In embodiments, the diameter of the non-spherical ball may be 73.45% of the diameter of the corresponding spherical ball. In this manner, the geometric center of the corresponding spherical ball is kept within the interior of the non-spherical ball, which allows this geometric center to also function as the center of mass of the non-spherical ball due to the at least one density differential or gradient within the interior of the ball.

Generally, the present invention provides an article comprising a non-spherical ball that is configured to fly without substantial eccentricity, or wobble, when thrown. The non-spherical ball is particularly suitable for training a softball pitcher or a baseball pitcher and to help athletes monitor and improve the spin of their throws and pitches via immediate visual feedback (the system or approach of the present invention may be referred to as "TrueView"). The non-spherical ball may comprise at least one density differential or density gradient which configures the center of the mass of the ball distributed so that it would be located in the geometric center of the outer sphere of the training ball, and in this manner, the non-spherical training ball gains a signature "feel" that is the same or substantially like that of an ordinary softball or baseball, for example. The training ball spins normally and has a smooth, equal spin, despite its not-entirely-symmetrical shape. In this manner, the athlete can effectively practice using the non-spherical training ball without needing to adjust technique to specifically accommodate the shape of the training ball.

In other words, the non-spherical ball is without a complementary portion which, if combined with the non-spherical ball, would form a corresponding spherical ball. The complementary portion may be any suitable shape, but in the shown embodiments, the complementary portion is a smaller spherical cap. In this manner, the spin may be more easily visualized when the ball is thrown.

In embodiments, the non-spherical ball may include indicia thereon, including but not necessarily limited to a color, a plurality of colors, a word, a phrase, a logo, and any combination thereof, which are configured to enhance and facilitate visualization of spin of the ball when thrown. In this manner, in combination with the non-spherical shape of the training ball, the spin may be maximally visualized by the athlete, coaches, umpires, and the like.

Referring now to the ball FIG. 1, the non-spherical ball may be sized and configured to resemble a softball by size and weight (e.g., 7±0.5 oz and a full softball-sized diameter felt by the pitcher when the ball is held), a baseball, or another type of ball, according to need. Accordingly, the non-spherical ball may have a total mass that is at least approximately equal to a total mass of a corresponding spherical ball, and in embodiments, the total mass of the non-spherical ball may be equal to the total mass of the corresponding spherical ball. In this manner, the non-spherical ball more closely resembles the corresponding spherical ball when used.

In embodiments, the non-spherical ball may include at least one seam that is raised relative to at least one corresponding seam of a corresponding spherical ball, and in embodiments, may have a tacky exterior surface configured to enhance a pitcher's grip of the ball. In this manner, the non-spherical ball may be more easily used during training or competition. In embodiments, the non-spherical ball may be made of silicon rubber, and may be manufactured via an injection molding process. Accordingly, while the present invention provides a non-spherical training ball that may be manufactured using any suitable method, in particular embodiments, injection molding may be employed for manufacture for economic viability as well as improved accuracy and precision in the manufacturing process.

Kits of the invention may comprise a training ball of the invention, optionally combined with one or more athletic accessories intended to facilitate the training process. Training or practice methods of the invention may comprise providing a training ball of the invention to an individual, observing the individual throw the training ball a first time, adjusting a technique of the individual to attempt to alter the spin of the training ball during the throw, and observing the individual throw the training ball a second time.

A non-spherical ball that is configured to fly without substantial eccentricity when thrown is provided. The non-spherical ball may have at least one density differential. And the at least one density differential may configure a center of mass of the non-spherical ball to be at or near a geometric center within the interior of the ball. The non-spherical ball may be without a complementary portion which, if combined with the non-spherical ball, would form a corresponding spherical ball. And the complementary portion may also be a spherical cap. The non-spherical ball may have indicia thereon configured to enhance visualization of spin of the ball when thrown. And the indicia may be selected from a group consisting of: a color, a plurality of colors, a word, a phrase, a logo, and any combination thereof. The non-spherical ball may have a diameter that is less than a diameter of a corresponding spherical ball. And the diameter of the non-spherical ball may be about 75% of the diameter of the corresponding spherical ball. Specifically, the diameter of the non-spherical ball may be 73.45% of the diameter of the corresponding spherical ball. The non-spherical ball may have at least one seam that is raised relative to at least one corresponding seam of a corresponding spherical ball.

The non-spherical ball may be made, or at least partially made, of a rubber material. The non-spherical ball may be manufactured via an injection molding process. The non-spherical ball may have a total mass that is at least approximately equal to a total mass of a corresponding spherical ball. The non-spherical ball may have a tacky exterior surface configured to enhance a pitcher's grip of the ball. The non-spherical ball may be configured for training a softball pitcher or a baseball pitcher.

In operation, the present application provides a training ball for training a pitcher to throw a ball with proper technique, such as a softball or baseball pitcher, and processes for manufacturing articles and kits of the invention. An article includes a non-spherical ball that is missing a portion, such as a smaller spherical cap portion, thereof. The training ball is non-spherical and includes a shifted center of mass due to the ball having at least one density differential or density gradient within the interior of the ball. Because the training ball is not geometrically symmetrical about all axes, the mass of the ball was distributed so that it would be located in the geometric center of the outer sphere of the training ball. Because of the redistribution of mass and relocation of the geometric center, the training ball feels similar or identical to an ordinary ball when held by the pitcher and, when thrown, spins similar or identical to an ordinary ball. The ball may include indicia thereon to enable athletes and trainers to effectively monitor spin imparted to the ball from a pitch.

The foregoing description of the exemplary embodiments is provided to enable any person skilled in the art to make or use the claimed subject matter. Various modifications to these embodiments will be readily apparent to those skilled in the art, and the generic principles defined herein may be applied to other embodiments without the use of the innovative faculty. Thus, the claimed subject matter is not intended to be limited to the embodiments shown herein but is to be accorded the widest scope consistent with the principles and novel features disclosed herein.

What is claimed is:

1. A non-spherical training ball for training a pitcher to throw a ball with proper technique, the training ball comprising:

a hollow body having a spherical exterior surface forming a spherical cap having a height greater than the radius of the sphere from which the spherical cap is formed and a substantially planar exterior surface forming the spherical cap plane;

a sidewall forming the hollow cavity of said hollow body, said sidewall having a spherical surface sidewall portion forming said spherical exterior surface of said hollow body and a substantially spherical interior surface of said hollow cavity, and said sidewall having a planar surface sidewall portion forming said substantially planar exterior surface of said hollow body and a substantially planar interior surface of said hollow cavity; and wherein the sidewall thickness of said planar surface sidewall portion has a thickness greater than the sidewall thickness of said spherical surface sidewall portion, wherein the difference in sidewall thickness between the planar surface sidewall portion and the spherical surface sidewall portion creates a density differential within the hollow body, said density differential configured to locate the center of mass of the hollow body in the geometric center of the sphere from which the spherical cap is formed.

2. The non-spherical training ball of claim 1, wherein the diameter of said non-spherical training ball is approximately 75% of the diameter of the sphere from which the spherical cap is formed.

3. The non-spherical training ball of claim 1, wherein said hollow body is made of rubber.

4. The non-spherical training ball of claim 1, wherein said hollow body is made of silicon rubber.

5. The non-spherical training ball of claim 1, wherein said spherical surface of said hollow body has raised surface seams.

6. The non-spherical training ball of claim 1, wherein said non-spherical training ball has indicia thereon to enhance visualization of spin of the ball when thrown.

7. The non-spherical training ball of claim 6, wherein said indicia is color.

* * * * *